United States Patent [19]

Kavoussi et al.

[11] Patent Number: 4,645,353

[45] Date of Patent: Feb. 24, 1987

[54] SCENT CLOCK ALARM DEVICE

[76] Inventors: James P. Kavoussi, 1401 - 80th St., Brooklyn, N.Y. 11228; Louise D. Hartford, 391 Durant Ave., Staten Island, N.Y. 10308

[21] Appl. No.: 720,528

[22] Filed: Apr. 8, 1985

[51] Int. Cl.[4] ..... G04B 47/00; G04B 23/02

[52] U.S. Cl. ..... 368/12; 368/72

[58] Field of Search ..... 368/10, 9, 12, 72–75, 368/250, 243; 222/70, 645–648

[56] References Cited

U.S. PATENT DOCUMENTS

| | | | |
|---|---|---|---|
| 3,289,886 | 12/1966 | Goldsholl et al. | 368/93 |
| 3,786,628 | 1/1974 | Fossard et al. | 368/12 |
| 4,407,585 | 10/1983 | Hartford et al. | 368/72 |

FOREIGN PATENT DOCUMENTS 54-18779 2/1979 Japan .

*Primary Examiner*—Vit W. Miska

*Attorney, Agent, or Firm*—Richard L. Miller

[57] ABSTRACT

A scent clock alarm device is provided which awakens the user with a scent instead of a noise or a light. In one embodiment of the invention a scent disc is provided which releases a fragrance when either heat or pressure is applied to the surface of the disc by a stylus. In this way a number of scents may be provided and selected. Another embodiment provides a system of scent cartridges in which the scent source is either liquid, solid or a combination of liquid and solid. In every embodiment the scent ceases abruptly when the alarm is turned off.

6 Claims, 6 Drawing Figures

SCENT CLOCK ALARM DEVICE

BACKGROUND OF THE INVENTION

The present invention relates generally to the field of alarm clocks, and, more specifically, to an alarm clocks which will awaken the user with a scent instead of a noise.

It is well-known that conventional alarm clocks awaken a sleeper by a buzzer and, in some instances, by a flashing light either used in conjunction with the buzzer or separately. However, a buzzer system can often startle the sleeper and cannot be heard by a hearing impaired user. Further, the flashing light may even be ineffective to a sleeper if he or she is blind or even if he or she is turned away from the light source so that the flashing light does not reach the eyes of the sleeper.

It has also been well established that the manner of awakening effects the disposition of the person awaken, so that a gentle nudge or the scent of pine needles is more likely to improve the disposition of the user, than say the use of a loud jarring bell.

L. Hartford et. al., U.S. Pat. No. 4,407,585, provides a variety of techniques for releasing a fragrance at some predetermined time, however, only a single fragrance may be easily selected and some fragrance may still be emitted even after the scent alarm has been turned off.

SUMMARY OF THE INVENTION

It is, therefore, a primary object of the present invention to provide a scent clock alarm device in which the scent may be easily selected by the user automatically without interchanging aerosols or chemicals.

Another object is to provide a scent clock alarm device which emits a fragrance during the alarm-on time but quickly extinguishes the scent when the alarm is turned off.

Another object is to provide a scent clock alarm device in which interchangeable scent discs may be used to provide a scent program in a manner analogous to that in which phonograph records are used to provide an audio program.

A further object is to provide a scent clock alarm device which uses a fragrance containing gravel which gives off a fragrance at room temperature.

A still further object is to provide a scent clock alarm device which uses a fragrance containing gravel which gives off a fragrance at elevated temperatures.

A yet further purpose is to provide a scent clock alarm device which uses a fragrance containing volatile liquid.

A yet further purpose is to provide a scent clock alarm device which uses a fragrance containing a solid whose fragrance is released upon contact with a liquid reagent.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
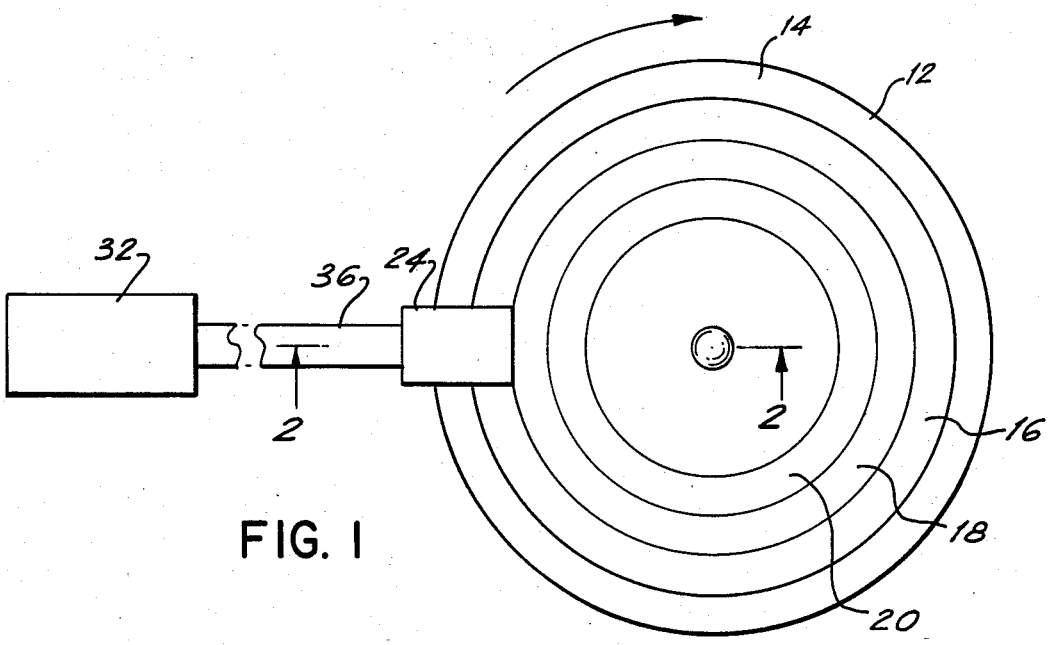
FIG. 1 is a top plan view of one embodiment of the invention.
Figure 2:
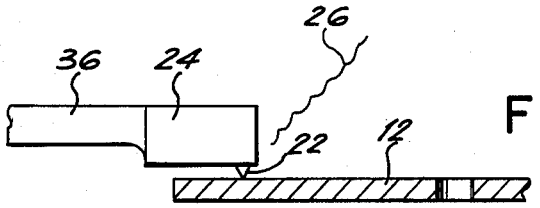
FIG. 2 is a partial front cross sectional view taken on line 2—2 of FIG. 1 showing the stylus in contact with the scent disc.
Figure 3:
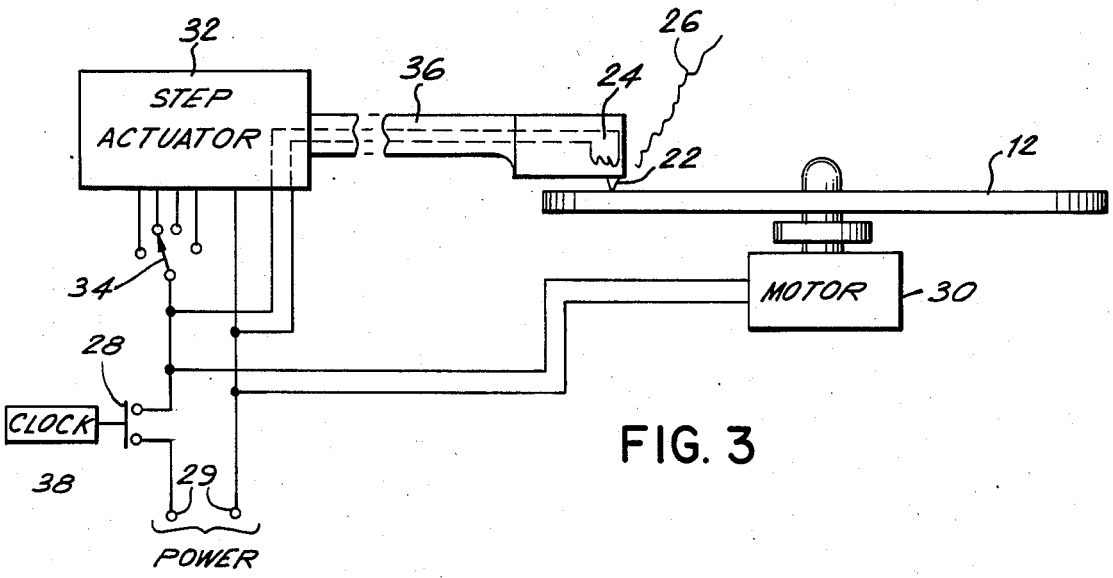
FIG. 3 is a diagrammatic representation of the embodiment illustrated in FIG. 1.

The scent clock alarm device embodying a scent disc may best be understood with reference to FIGS. 1, 2 and 3. The scent disc 12 is impregnated with a number of bands of fragrant substances, represented by numerals 14, 16, 18 and 20. These bands may be designed to release their fragrances upon either the application of heat or pressure. Each band may contain a different scent. For example band 14 may contain the scent of pine needles, while band 16 may yield the scent of roses. For the sake of illustration, the figures show the invention as applied to a heat activated fragrance, although a pressure activated fragrance could be used with the elimination of the heat source.

It is to be noted that in general scent disc of a similar chacter to scent disc 12, but with only a single fragrance are commercial purchasable from Remington Products, Inc. and market under their non registered trademark AROMA DISC TM.

A stylus 22, mounted to heating element 24 heats scent disc 12 at the point of contact, giving off fragrance 26. When alarm trip switch 28 is contained in and actuated by an accessory clock 38 as is well known in the art, power at terminals 29 flows to motor 30, heating element 24 and step actuator 32. Motor 30 keeps scent disc 12 spinning so that a large surface area is heated, one small area at a time so that the scent emitted is constant and controlled. Fragrance selector switch 34 controls the operation of step actuator 32 and the extension of actuation arm 34 permitting fragrances to be chosen by the user.

Figures 4, 5, 6:
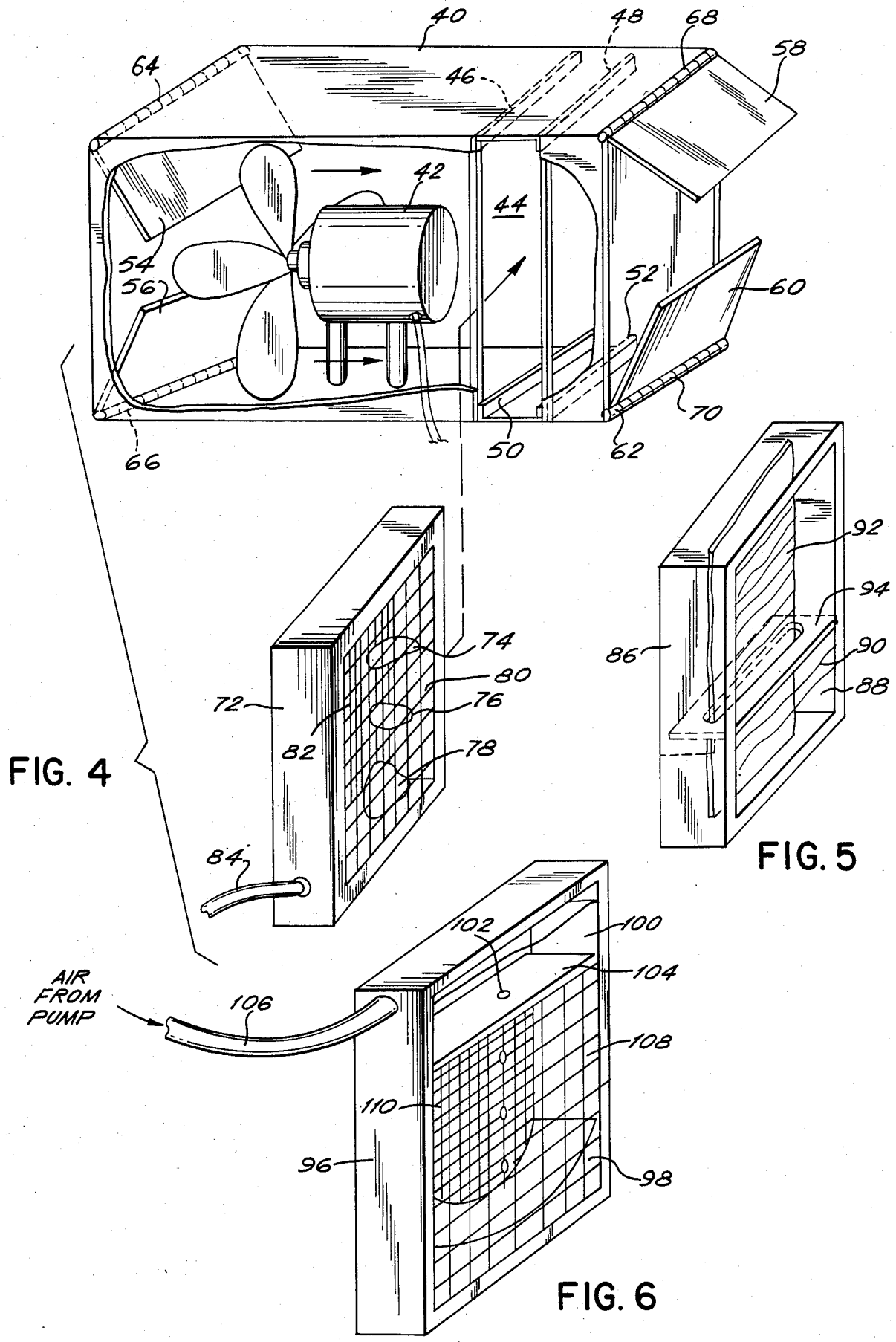
FIG. 4 is a perspective partial cutaway view of another embodiment of the invention shown with a fragrance cartridge about to be inserted. The cartridge contains solid gravel type fragrance.
FIG. 5 is a perspective view of another fragrance cartridge, similar to FIG. 4, where the cartridge contains a liquid type fragrance.
FIG. 6 is a perspective view of yet another fragrance cartridge, similar to FIG. 4, where the cartridge contains a combination solid-liquid type fragrance.

The operation of another embodiment of the invention which uses fragrance cartridges, instead of fragrance discs may best be understood with reference to FIGS. 4, 5, and 6. In FIG. 4, the container 40 contains a fan 42, which, when operating, forces air to pass through any scent cartridge which is inserted into slot 44 which is equipped with guide tabs 46, 48, 50 and 52. In order to prevent the escape of fragrance when the alarm is turned off, i.e. when the fan 42 is not operating, vanes 54, 56, 58 and 60 are provided. These vanes are normally held closed by helical springs, typified by 62, located at both ends of hinges 64, 66, 68 and 70 respectively. However vanes 54, and 58 can be biased instead by gravitational forces as is well known in the art.

Cartridge 72 in FIG. 4 contains fragrance containing gravel 74, 76 and 78 held between front wire mesh 80 and rear wire mesh 82. If the gravel is volatile at room temperatures, no heat source is necessary. However, if the gravel is volatile at elevated temperatures, then meshes 80 and 82 may be used as resistive heating elements powered by electrical cable 84.

Another embodiment of the fragrance cartridge is illustrated in FIG. 5 where fragrance cartridge 86 uses a fragrance containing volatile liquid 88. Air may be made to flow directly over the top surface 90 of liquid 88 or a wick 92, supported by plate 94 may be used to increase the rate of evaporation of liquid 88.

Still another embodiment of the fragrance cartridge is illustrated in FIG. 6, where cartridge 96 is equipped with a fragrance containing solid 98 which is activated by droplets of liquid 100 which descend through aperture 102 in plate 104 when air pressure is applied though tubing 106. Front mesh 108 and rear mesh 110 allow air to blow through cartridge 96.

While certain novel features of this invention have been shown and described and are pointed out in the annexed claims, it will be understood that various omissions, substitutions and changes in the forms and the details of the device illustrated and in its operation can be made by those skilled in the art without departing from the spirit of the invention.

What is claimed is:

1. A scent clock alarm device, comprising in combination:

(a) a fragrance containing medium which is a disc upon whose surface is impregnated at least one band of fragrant substance which is released upon the application of heat whereby a different fragrance is obtained for each band to which said heat is applied;

(b) means for converting said medium into an air-borne volatile substance; and, (c) means for interfacing with a clock such that said conversion of said medium into an air-borne volatile substance commences at a predetermined time.

2. A scent clock alarm device, as recited in claim 1, wherein said means for converting said medium into an air-borne volatile substance comprises a heated stylus which causes said disc to release a fragrance; a motor which rotates said disc; a step actuator which determines the band upon which said heated stylus rests; and, a fragrance selector switch which controls the operation of said step actuator thereby determining which fragrance is released.

3. A scent clock alarm device, as recited in claim 2, wherein said means for interfacing with a clock such that said conversion of said medium into an air-borne volatile substance commences at a predetermined time comprises an alarm trip switch whose closure is controlled by said clock such that, upon closure of said switch power is supplied to said heating element, said step actuator, and said motor.

4. A scent clock alarm device, comprising in combination:

(a) a fragrance containing medium which is a disc upon whose surface is impregnated at least one band of fragrant substance which is released upon the application of pressure, whereby a different fragrance is obtained for each band to which said pressure is applied;

(b) means for converting said medium into an air-borne volatile substance; and, (c) means for interfacing with a clock such that said conversion of said medium into an air-borne volatile substance commences at a predetermined time.

5. A scent clock alarm device, as recited in claim 4, wherein said means for converting said medium into an air-borne volatile substance comprises a stylus in contact with said disc which causes said disc to release a fragrance; a motor which rotates said disc; a step actuator which determines the band upon which said stylus rests; and, a fragrance selector switch which controls the operation of said step actuator thereby determining which fragrance is released.

6. A scent clock alarm device, as recited in claim 5, wherein said means for interfacing with a clock such that said conversion of said medium into an air-borne volatile substance commences at a predetermined time comprises an alarm trip switch whose closure is controlled by said clock such that, upon closure of said switch power is supplied to said step actuator and said motor.

* * * * *